US005465458A

United States Patent [19]

Schlager

[11] Patent Number: 5,465,458

[45] Date of Patent: Nov. 14, 1995

[54] RETAINER FOR TOWELS, GARMENTS, AND THE LIKE

[76] Inventor: Gary S. Schlager, 5326 Connecticut Ave., NW., Washington, D.C. 20015

[21] Appl. No.: 158,694

[22] Filed: Nov. 29, 1993

[51] Int. Cl.[6] ..... B43M 9/00

[52] U.S. Cl. ..... 16/1 R; 16/DIG. 8; 211/16; 248/504; D21/196

[58] Field of Search ..... 16/1 R, DIG. 8; D21/196, 197; D19/96, 97, 32–34; 116/234; 248/364, 500, 504; 211/16

[56] References Cited

U.S. PATENT DOCUMENTS

| | | | |
|---|---|---|---|
| 217,768 | 7/1879 | Bonham . | |
| 297,148 | 8/1888 | Freedman . | |
| 1,512,130 | 10/1924 | Pardue | 211/16 |
| 1,800,030 | 4/1931 | Reynolds | 211/16 |
| 1,883,965 | 10/1932 | Kratz | 16/1 R |
| 2,506,815 | 1/1948 | Shaffer . | |
| 2,765,487 | 10/1956 | Foster | 16/1 R |
| 3,863,882 | 2/1975 | Hatcher | 248/364 |
| 4,339,142 | 7/1982 | Tanner et al. | 16/1 R |
| 4,345,345 | 8/1982 | Holtz . | |
| 4,776,049 | 10/1988 | Perron . | |
| 4,943,066 | 7/1990 | Lathin et al. . | |
| 5,116,014 | 5/1992 | Slavens et al. | 16/1 R |

FOREIGN PATENT DOCUMENTS

| | | | |
|---|---|---|---|
| 130780 | 12/1932 | Austria | 116/234 |
| 551635 | 10/1956 | Belgium | 53/413 |

*Primary Examiner*—Lowell A. Larson
*Assistant Examiner*—Donald M. Gurley
*Attorney, Agent, or Firm*—John J. Schlager

[57] ABSTRACT

A retainer for securing towels, garments, papers and the like to railings, fences, ground, etc. comprises two or more weight members spaced or separated by a generally flexible elongated connector which joins them together. Preferably, the weight members will be sac-like or pouch-like receptacles filled with loose pellets and connected together by nylon strap or webbing.

10 Claims, 2 Drawing Sheets

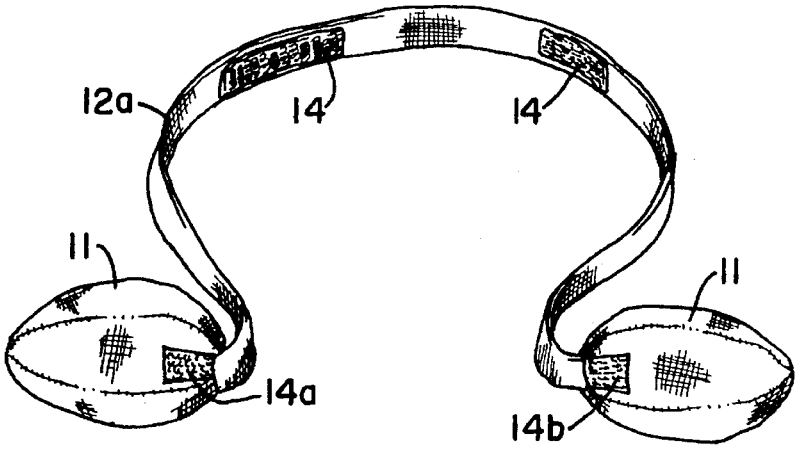
FIG. 4
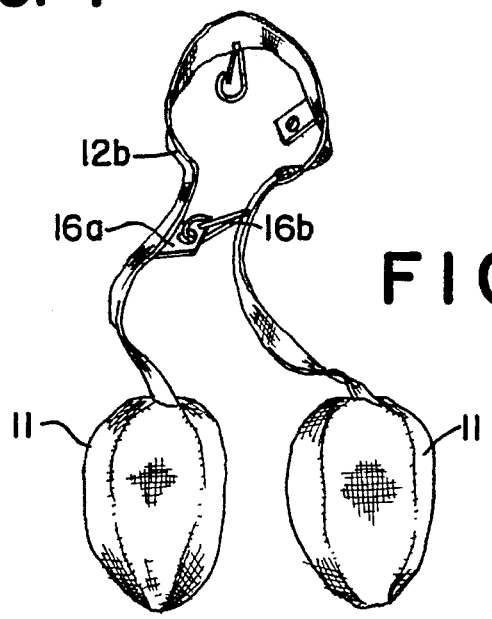
FIG. 5
FIG. 6
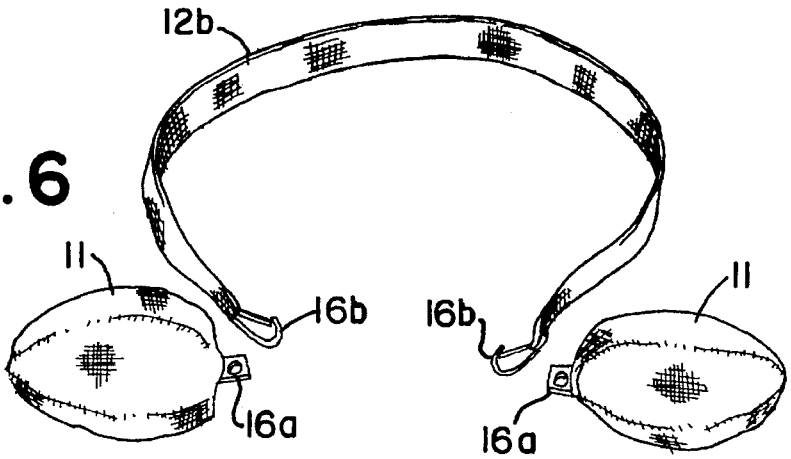

RETAINER FOR TOWELS, GARMENTS, AND THE LIKE

BACKGROUND OF THE INVENTION

This invention relates to a retainer comprising two or more weight members separated by and interconnected with a generally flexible elongated interconnecting member, said retainer being generally useful for retaining, holding down or securing relatively light or thin articles, such as towels, garments, sheets, blankets, papers and the like.

A practical need exists for securing wet or damp towels, blankets, and garments such as bathing suits, on balcony or deck railings, fences, etc., in and around beach resorts, swimming pools, home decks, boats, yards, etc. Upon drying, such articles are susceptible to becoming dislodged, blown or carried away, sometimes by even slight wind conditions. There is a similar need to temporarily secure dry blankets, garments, paper goods, (e.g. spread-out newspapers), and the like, to relatively horizontal surfaces such as a sandy beach, grassy picnic area, boat or home deck, swimming pool patio, and the like.

SUMMARY OF THE INVENTION

It is the object of the invention to satisfy the above needs by providing a retainer comprising two or more weight members or weighted objects having sufficient weight to secure a towel or garment to a railing or relatively horizontal surface and the like, said weighted objects being interconnected by a generally flexible elongated interconnecting member. The weight members will generally have a larger diameter or horizontal dimension than the width of the flexible elongated interconnecting member, and will also be substantially heavier than said interconnecting member. In the preferred embodiment, wherein a towel or garment is to be secured to a railing or fence, the retainer of the invention will thus provide two points of weight hanging in a downward direction on either side of the item to be retained, to thereby retain such item. The weight members will preferably be two in number, and will preferably be in the form of flexible receptacles. Most preferably, they will be in the form of sac-like or pouch-like receptacles having a relatively smooth and flexible outer fabric shell, and containing loose pellets or other granular material to provide the necessary weight. The shape of such receptacles will most preferably be generally spheroidal or ellipsoidal, although it will be readily recognized that other geometric shapes can also be employed, such as rectangular, pyramidal, cubic, etc.

The receptacles will preferably be filled with the loose pellets to almost full capacity, but not to the point where they are near the bursting point, or where they will be caused to become relatively hard, as it will be preferred from the aesthetic standpoint to maintain a relatively flexible and pliable "feel". They will also be preferably of a size and nature as to be conveniently lifted and "tossed" onto a railing and the like. Most preferably, each receptacle will conveniently fit into the palm of an average human adult hand. For example, in the case of the preferred sac-like or pouch-like generally spheroidal or ellipsoidal receptacles, the typical dimensions will range from about 2.5 to about 4.5, preferably about 3.0 to about 4.0, inches in diameter. In the case of ellipsoidal receptacles, this refers to the shorter diameter. The larger diameter will typically be in the range of about 3.0 to about 5.0 inches, preferably about 3.5 to about 4.5 inches.

As a unit, the retainer of the invention will preferably have an overall weight of between about 0.75 and about 1.75 lb., preferably about 1.25 to about 1.75 lb. This weight has proven sufficient to secure and retain most towels and light garments in high wind conditions.

It will be observed that the retainer of the invention has the dual function of being adaptable to both securing towels and garments hanging or draping over a railing or fence, and lying relatively flat on a sandy beach, boat or home deck, picnic site, swimming pool patio area, etc. Due to the flexible nature of the elongated interconnecting member (hereinafter "elongated connector" or "connector") the weighted receptacles (e.g., sac-like or pouch-like spheroidal receptacles) can be made to hang down together, or can be stretched apart by the length of elongated connector, depending on the end use.

The length of the elongated connector will usually be determined by the intended end use of the retainer. Where, for example, a damp towel or bathing garment is to be conveniently and readily draped over a railing, the length of the connector will be sufficient to cause each weighted receptacle to hang down a substantial and sufficient distance from the top of the railing, so as to achieve sufficient holding power in high wind conditions.

It will also be recognized that the configuration described herein lends itself to a multiplicity of uses because of its ready adaptability to being draped over a railing, or to being made to lie outstretched on a relatively horizontal surface, e.g. to secure a towel, blanket, open newspaper, etc. For example, the retainer of the invention will find multiple uses in around the boating community, on docks, bulkheads, cabin tops, sterns, etc. It can also be used on rocky areas typically found around lakes or ocean bays, or on sand dunes and the like; in short on any surface where the weight members will provide sufficient holding power to avoid dislodging of the particular item to be retained.

The flexible elongated connector will preferably be a strap or piece of webbing made of nylon, polyester, or other synthetic quick-drying, water-resistant or water repellent material. They are commonly used for holding and securing backpacks and other outdoor gear. The cover or shell of the weighted receptacles will preferably be a fabric made of similar materials, and will usually have a different weight and a relatively smooth "feel" and texture. Such materials are commonly selected for their strength and durability. Commonly used "all-weather" materials are well-known as "supplex", "house-flag", "cordura", etc., all of which can be employed. Various blends of synthetic or synthetic/natural materials can also be employed.

BRIEF DESCRIPTION OF THE DRAWINGS

FIG. 4 is a perspective view of the retainer of the invention showing the embodiments that provide means for adjusting the length of the flexible connector (12*a*) as described on page 4 (last paragraph ), utilizing tabs of pile fabric material (14) on the flexible connector, or utilizing such tabs (14*a*) on one or both of the receptacles (11).

FIG. 5 is a perspective view of the retainer of the invention showing the embodiment of the invention that provides another means of adjustability of the flexible connector (12*b*) as described on page 4, utilizing fasteners (16*b*) and tabs (16*a*) provided with grommet holes.

FIG. 6 is a perspective view of the retainer of the invention showing the embodiment described on page 5 wherein the flexible connector can be releaseably secured to the receptacles (11) via fasteners (16*b*) on the end of the connector (12*b*) and tabs (16*a*) provided with grommet holes and attached to the receptacles.

DETAILED DESCRIPTION OF THE INVENTION

Figure 1:
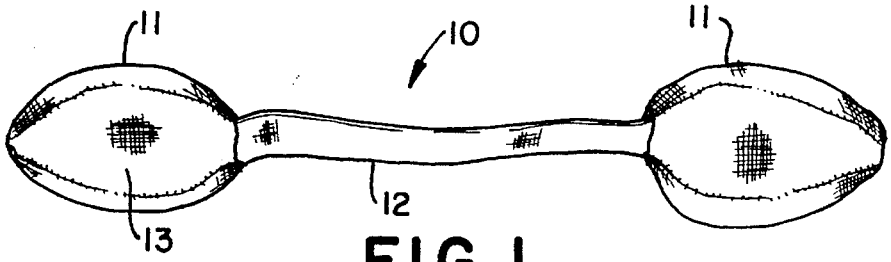
FIG. 1 is a perspective view of the retainer of the invention showing a preferred embodiment.

Turning to FIG. 1, a preferred embodiment of a retainer of the invention is shown generally at 10 and basically includes two fabric-covered weighted flexible receptacles 11 (spheroidal or ellipsoidal in shape) which are filled with loose pellets (not shown) and are interconnected by a flexible elongated connector 12, such as a strap or webbing.

Figure 2:
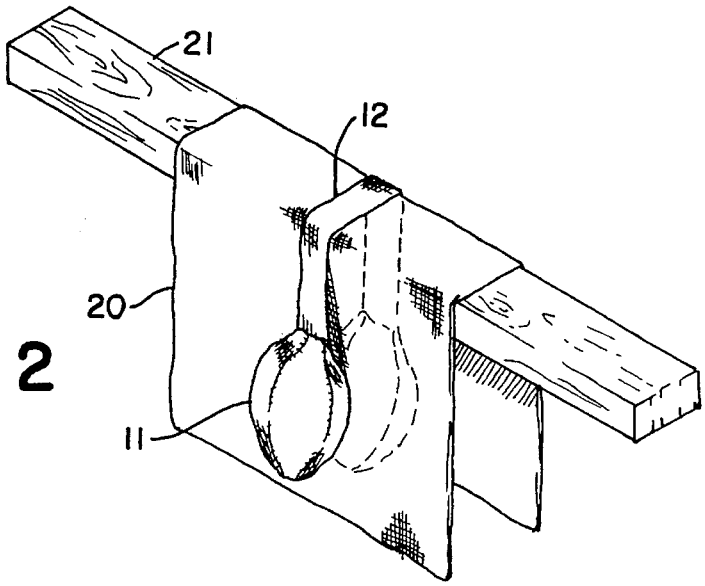
FIG. 2 is a perspective view of the retainer of the invention securing a towel on a railing section.

As illustrated in FIG. 2, when a towel 20 (or other article such as a bathing suit, sheet, blanket, etc.) is to be draped over a railing 21 and the like, two points of weight are provided by the two weighted receptacles 11 hanging down on either side of the towel 20 so that it is secured in place both by the receptacles 11 and by the interconnecting strap or webbing 12.

Figure 3:
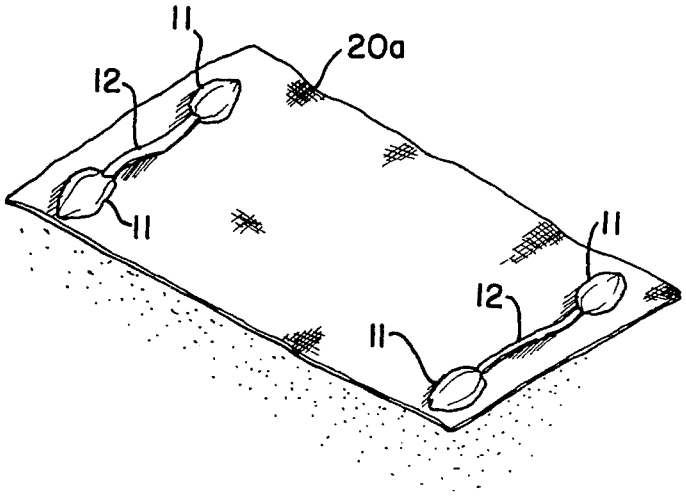
FIG. 3 is a schematic of two retainers of the invention holding down a towel or blanket on sand or grass.

As illustrated in FIG. 3, the retainer 10 of the invention is also useful for securing a towel, blanket, and the like on the sand, grass, ground and the like. In this case, one or two retainers are used with the weighted receptacles 11 outstretched and separated apart by the strap or webbing 12 and positioned appropriately on the towel 20*a* or other item to be secured.

The pellets or granular material used to fill the flexible receptacles will preferably be made of a plastic type material such as polypropylene, polyethylene, polystyrene, and the like. They may be of any suitable size and shape (beads, cylinders, flat oval disks, etc.) to convey a desirable "feel". Preferably, the pellets will have a diameter of between about 1/16 inch and about 3/16 inch at the widest point. One especially preferred example is in the form of polypropylene pellets in the shape of relatively flat oval disks, measuring about 1/8 inch in diameter at the widest point, manufactured by Fairfield Processing Corporation, of Danbury, Conn. Other granular materials may be used.

The flexible connector 12 will most preferably be nylon webbing, preferably 0.5 to 1.5 inches in width, most preferably 0.75 to 1.25 inches. Typical connector lengths (between receptacles) found useful for most purposes will range between about 10 and about 22 inches; e.g., about 14 to about 18 inches. It will be recognized that other widths and, particularly, lengths may be employed to satisfy different primary needs. For example, to secure a very large object such as a beach blanket or sheet, the length of the flexible connector 12 will need to be substantially greater than that previously described.

In this connection, it is also within the purview of this invention that the flexible connector 12 be not only of fixed length but also be elastic or of adjustable length. To allow for adjustability, various well-known adjustment means can be employed such as buckles, hooks, loops, "Velcro"™ pile fabric tabs, etc. whereby the flexible connector 12 can, if desired, be "doubled over" to readily shorten its length and "released" to expand to its normal full length. Such adjustment means are commonly employed, for example, on straps used to hold binoculars, cameras, back-packs, waist-packs, and the like. In addition, "Velcro"™ pile fabric tabs (and corresponding adhering tabs) can be readily positioned at different sites along the length of the flexible connector 12 so that the connector can be conveniently shortened simply by pressing two corresponding tabs together thereby forming a loop of excess and temporarily unused length. Such tabs can also be mounted on one or both receptacles 11 themselves, so that the receptacles 11 can be positioned at any of several sites along the length of the connector 12 to thereby "shorten" or "lengthen" the effective distance between them.

Where webbing is employed as the flexible connector 12, it will preferably be attached to the preferred fabric-covered sac- or pouch-like receptacles 11 by sewing or stitching each end of the webbing 12 into a seam of the outer fabric cover. The material utilized is preferably synthetic polyester thread. In addition, for maximum holding power, the end portions of the webbing 12 can also be made to encircle the outer perimeter of the receptacle and then stitched along this partial length to the outer fabric cover.

Other connecting means can also be employed. For example, the webbing can be permanently or releaseably secured to the receptacles via tabs stitched into the receptacles, which tabs are provided with reinforced grommet holes adapted to receive conventional hooks or fasteners attached to the ends of the webbing. Other conventional fastening means can readily be employed, e.g. "key-chain" clips, rings, etc. Further, tabs of pile fabric materials (e.g. "Velcro"™) can be mounted by stitching or glueing to the receptacle cover and to the webbing ends (or to intermediate sites) for convenient attaching and detaching.

To illustrate one method of forming the receptacles, the outer cover of the receptacles 11 is first fabricated as follows. Four identical sections 13 are formed from the fabric material to be employed as the cover material. Two of these sections are stitched together along juxtaposed edges to generally form one open half of a receptacle 11. A second open half of the receptacle is formed in like fashion, and lined up with its edges juxtaposed with those of the first half. These two halves are then stitched, but prior to completion of the stitching of the two halves together, a piece of webbing 12 (preferably reinforced by slight doubling over at the end) is inserted at one open end of the receptacle at the point that the webbing is to be attached. The receptacle opening is then closed around the webbing, and the webbing is attached by the final stitching. Further, at a point in the operation, a small opening is left in one of the seams and polypropylene pellets in the form of flat oval solid disks of about 1/8 inch diameter ("Poly-Pellets"™) are poured into the opening until the receptacle is filled with the loose pellets as previously described. This opening is then stitched closed.

While the invention has been described in detail and in conjunction with a specific embodiment, it is to be understood that such description is illustrative only and that many alternatives, modifications and variations will be apparent to those skilled in the art. Accordingly, the foregoing description is not intended to limit the present invention or otherwise exclude any such alternative, modification, variation, or any equivalent configuration or arrangement, that fall within the spirit and scope of the invention.

I claim:

1. A retainer comprising at least two spaced or separated flexible closed receptacles, and a generally flexible, elongated, flat or strap-like interconnecting member joining said closed receptacles together and spacing them apart a predetermined length, said member having a length which is substantially greater than its width, said receptacles containing loose water-resistant or water-repellent pellets or granular material.

2. The retainer of claim 1, wherein said interconnecting member has sufficient length and flexibility to allow it to be draped over an article to be retained on a fence or railing to thereby provide two points of weight hanging downwardly on either side of said article.

3. The retainer of claim 2, wherein said pellets or granular material are composed of plastic.

4. The retainer of claim 3, wherein said receptacles are filled to essentially full capacity with said pellets or granular material.

5. The retainer of claim 2, wherein said interconnecting member is provided with adjustment means for lengthening or shortening its length to accommodate different-sized articles to be retained.

6. The retainer of claim 1, wherein said receptacles are generally spheroidal or ellipsoidal in shape.

7. The retainer of claim 1, wherein said receptacles and said interconnecting member are composed of weather-resistant fabric and said interconnecting member is composed of weather-resistant strap or webbing.

8. The retainer of claim 7, wherein said strap or webbing is attached to said receptacles by means of stitching or fasteners.

9. The retainer of claim 7, wherein one or both of said receptacles and said strap or webbing are provided with tabs of pile fabric material appropriately positioned to enable attachment and detachment of said strap or webbing from said receptacles.

10. The retainer of claim 8, wherein the ends of said strap or webbing are provide with fasteners, and said receptacles are provided with tabs containing grommet holes adapted to receive said fasteners.

* * * * *